United States Patent [19]

Brown, deceased et al.

[11] 4,069,879

[45] Jan. 24, 1978

[54] PIPE HANDLER

[76] Inventors: Cicero C. Brown, deceased, late of Houston, Tex.; by Joe R. Brown, executor, P.O. Box 19236, Houston, Tex. 77024

[21] Appl. No.: 732,997

[22] Filed: Oct. 15, 1976

[51] Int. Cl.[2] ..... E21B 19/16

[52] U.S. Cl. ..... 175/57; 175/85

[58] Field of Search ..... 175/57, 85, 202

[56] References Cited

U.S. PATENT DOCUMENTS

| | | | |
|---|---|---|---|
| 2,450,934 | 10/1948 | Calhoun | 175/85 |
| 3,288,000 | 11/1966 | Foster | 175/85 |
| 3,921,823 | 11/1975 | Bourree et al. | 175/85 |
| 3,929,235 | 12/1975 | Howard et al. | 175/85 |

*Primary Examiner*—James A. Leppink

*Attorney, Agent, or Firm*—Browning, Bushman & Zamecki

[57] ABSTRACT

Disclosed are apparatus for manipulating pipe members in operating on a well, including a frame that is movable along the floor of the drilling derrick and which is equipped with a clamp for guiding pipe members toward and away from the well bore, guides for vertically orienting pipe members and aligning them with the well bore, and powered tongs for making and breaking threaded joints between pipe members and the drill string located in the well bore. In a method of manipulating pipe members in operating on a well with a mast-supported elevator, pipe members supported by the elevator are guided toward and away from the well bore area by a pipe manipulator movable along the working floor, aligned by the pipe manipulator, and threadedly joined to, or disengaged from, the drill string in the well bore by powered tongs carried by the pipe manipulator.

41 Claims, 13 Drawing Figures

PIPE HANDLER

BACKGROUND OF THE INVENTION

1. Field of the Invention

The present invention relates to apparatus and methods for manipulating tubular members. More particularly, the present invention pertains to apparatus and methods for guiding and aligning pipe members during operations on a well, including making and breaking drill string joints.

2. Description of Prior Art

Current operations on wells wherein drill pipe or casing members are maneuvered into or out of well bores are generally carried out with combinations of machinery and manpower. In a typical drilling operation, a drill string is made up of pipe members threadedly joined together and inserted into the well to drive the drill bit. Pipe members are moved from a storage area to a vertical orientation directly over the well bore to be added to the drill string as the well bore is deepened. Then, the joint between each new pipe member and the last pipe member at the top of the drill string is formed by threading the pipe members together. An elevator, or other gripping device, may be used to raise the pipe member to move it to the well bore, but the pipe is guided generally by manpower. The threaded pipe joint is usually made up using tongs, manipulated and operated by hand. In the reverse operation, such a joint is broken, or loosened by hand-operated tongs, and the broken out pipe member is again guided by manpower toward the storage area.

Due to the size and weight of typical drill pipe members, such operations in manipulating pipe are inherently dangerous. The dangerous quality of the operations increases where pipe stands, composed of two or three pipe members joined together, are maneuvered as single units. Similar operations involving heavier casing members being inserted to line a well bore also pose a danger.

Such operation on wells could be made safer by reducing the need for manhandling pipe members and equipment, such as tongs. Also, by eliminating the presence of one or more workers from the well vicinity, as well as increasing the use of remote control to operate well working tools, the cost of working wells may be reduced.

SUMMARY OF THE INVENTION

Apparatus of the present invention include a frame, movable along a path, and forming a way that is generally perpendicular to the path. A clamp, designed to engage pipe members, is mounted on a slide that is constrained to move along the way. Thus, movement of the clamp along the way, and the frame along the path, combine to permit motion of the clamp in two generally orthogonal directions and, therefore, in a plane. A guide is mounted on the frame for selectively engaging a pipe member to substantially constrain its movement to rotational motion about, and longitudinal motion along, its cylindrical axis. A tong device is also supported by the frame to selectively impart torque to rotate the pipe member about its axis. In particular, the tong, or torque, device includes two gripping elements that may be operated to selectively, and simultaneously, apply torque to two pipe members in opposite senses, when the pipe members are aligned with essentially a common cylindrical axis. Thus, the tong device can be used to make, or break, a threaded joint between two pipe members with mating, threaded ends.

The present invention may be particularly applied to the manipulation of pipe members in operations on a well. The apparatus of the present invention is positioned on the floor, or working level, of a derrick or mast assembly, and constrained to move along a track, or other path defining device. The track is oriented to straddle a hole in the floor leading to the well bore below, and to permit the frame to be moved to a point substantially adjacent the edge of the floor at which pipe members may be moved into and out of the well working area.

An elevator, or other pipe supporting device, is suspended from the derrick, and used to lift pipe members. As the elevator raises a pipe member, the pipe member is generally constrained by the clamp and guided as the frame is moved back along the path, and the clamp is moved along the way. This combination of motion of the elevator, frame and clamp combine to maneuver the pipe member to a vertical orientation in a position over the well bore. Then, with the pipe member in contact with the top of the drill string extending up from the well bore, the tong device engages both the elevator supported pipe member and the pipe member at the top of the drill string. Operation of the tong then imparts torque to the suspended pipe member and to the top of the drill string in opposite senses to threadedly join the pipe member to the drill string. The drill string, with the attached pipe member, may be lowered into the well bore as drilling progresses. When the drill string has been sufficiently lowered so that a new pipe member may be attached, the aforementioned process is repeated.

The steps of adding a pipe member to the drill string, using the maneuvers described hereinbefore, may be generally reversed to remove pipe members from the drill string and return them to a receiving, or storage, location. Thus, the elevator is used to raise the drill string until at least one pipe member extends above the well floor, and the tong device is operated to apply torgue to unthread the joint at the base of this elevated pipe member. Then, as the elevator continues to support the pipe member, the clamp and frame are maneuvered to guide the pipe member toward the storage area. This process is repeated until all the pipe members intended to be removed from the well bore are returned to storage.

The apparatus and method of the present invention may be used to maneuver pipe stands as well as individual pipe members. When pipe stands are being manipulated, it is necessary to use the tong device to make, or break, threaded joints only at the ends of the pipe stands.

All of the movements of the apparatus used to maneuver pipes in the present invention may be carried out with the use of appropriate motors or fluid pressure devices. These power sources may be operated remotely from a control position on the operating floor of the derrick, or removed therefrom. The entire operation of manipulating pipe members about the working area of the derrick floor as discussed hereinbefore, may be carried out without the need of manhandling the pipe members, or any of the maneuvering equipment. Furthermore, though the tong device may be used to start a threaded joint, or loosen one to be broken, and additional equipment, known in the art, may be used to complete each such operation, the tong device may be operated so as to completely tighten or disassemble such a threaded joint. In any event, the need for personnel in the immediate pipe maneuvering area is at least reduced, or eliminated altogether with the present invention. Also, with such increased dependence on machinery to carry out the otherwise dangerous operation of manipulating pipe members, the speed with which such manipulations are carried out may also be increased, with the ultimate possibility of making such well working operations less costly.

DESCRIPTION OF THE PREFERRED EMBODIMENTS

The pipe handler of the present invention is shown at 10 in FIGS. 1–4. A frame 12, featuring a generally horizontal lateral member **12*a* serving as a way, and a pair of trolley assemblies 12*b*, is the support structure for the pipe handler 10. The frame 12 is movable on the trolleys 12*b*, along a path defined by a track system comprising rails 14*a* and 14*b*. Details of the operation of the trolleys 12*b* on the rails 14*a* and 14*b*, as well as the propulsion mechanism of the pipe handler 10** along the track system, are discussed hereinafter.

A clamp assembly, shown generally at 16, is mounted on a slide 18 which is movable along the way **12*a*. The slide 18 is in the form of a sleeve with rectangular cross section, circumscribing the way 12*a***, and fitted to the way sufficiently loosely to permit movement of the slide along the way, yet tightly enough to generally preclude rotational motion of the slide relative to the way.

Figure 2:
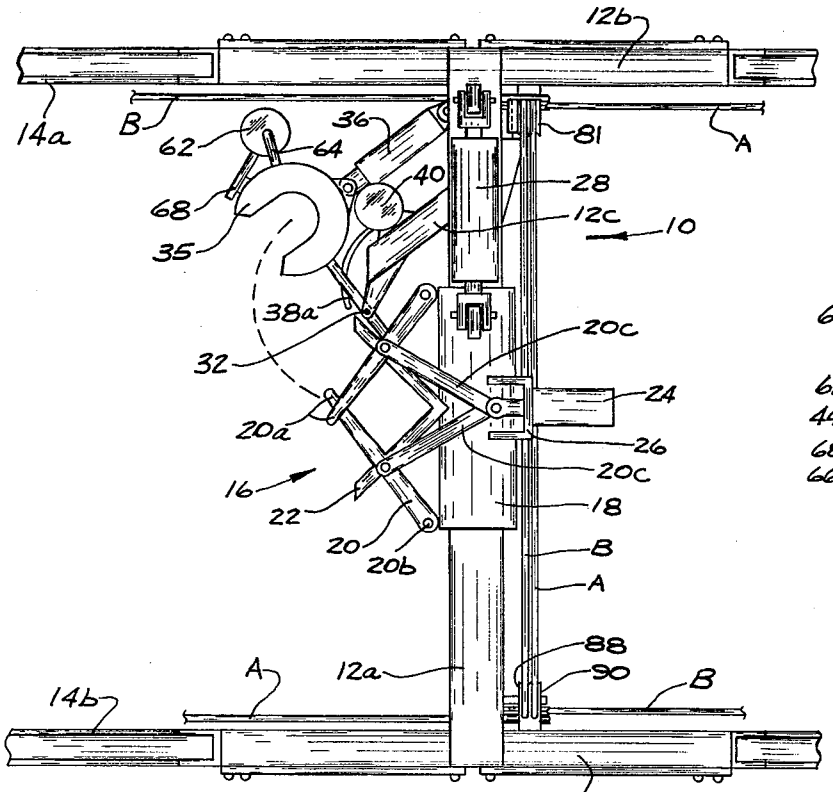
FIG. 2 is a plan view of the pipe handling apparatus.

The clamp assembly 16 is generally a combination of a latch 20 and a cradle 22. As best seen in FIG. 2, the latch 20 is in the form of a hinged finger system, anchored to the slide 18, and selectively operated by a fluid pressure piston and cylinder assembly 24. A pair of locking fingers **20*a* are each hinged to the slide 18 by hinge pins 20*b*. Each locking finger 20*a* is also hingedly connected to the fluid pressure assembly 24 by an operating finger 20*c*. A mounting frame 26 supports the fluid pressure assembly 24 on the slide 18. The fluid pressure assembly 24 may be operated to selectively open or close the combination of locking fingers 20*a* to engage and secure a pipe member within the confines of the locking fingers, or to release a pipe member from such confinement. When the fluid pressure assembly 24 is operated to cause the piston to force the operating arms 20*c* forward, that is, away from the fluid pressure assembly 24, the locking fingers 20*a* are also driven forward. Since the locking fingers 20*a* are constrained by the hinge pins 20*b*, this forward motion causes the locking fingers to rotate forwardly and laterally in opposite directions to a generally "open" configuration. When the fluid pressure assembly 24 is operated in the opposite sense, drawing the operating fingers 20*c* backwardly, the locking fingers 20*a* rotate about their respective hinge pins 20*b*** in the opposite senses, and are moved to mutually overlap and define a "closed" configuration.

Figure 1:
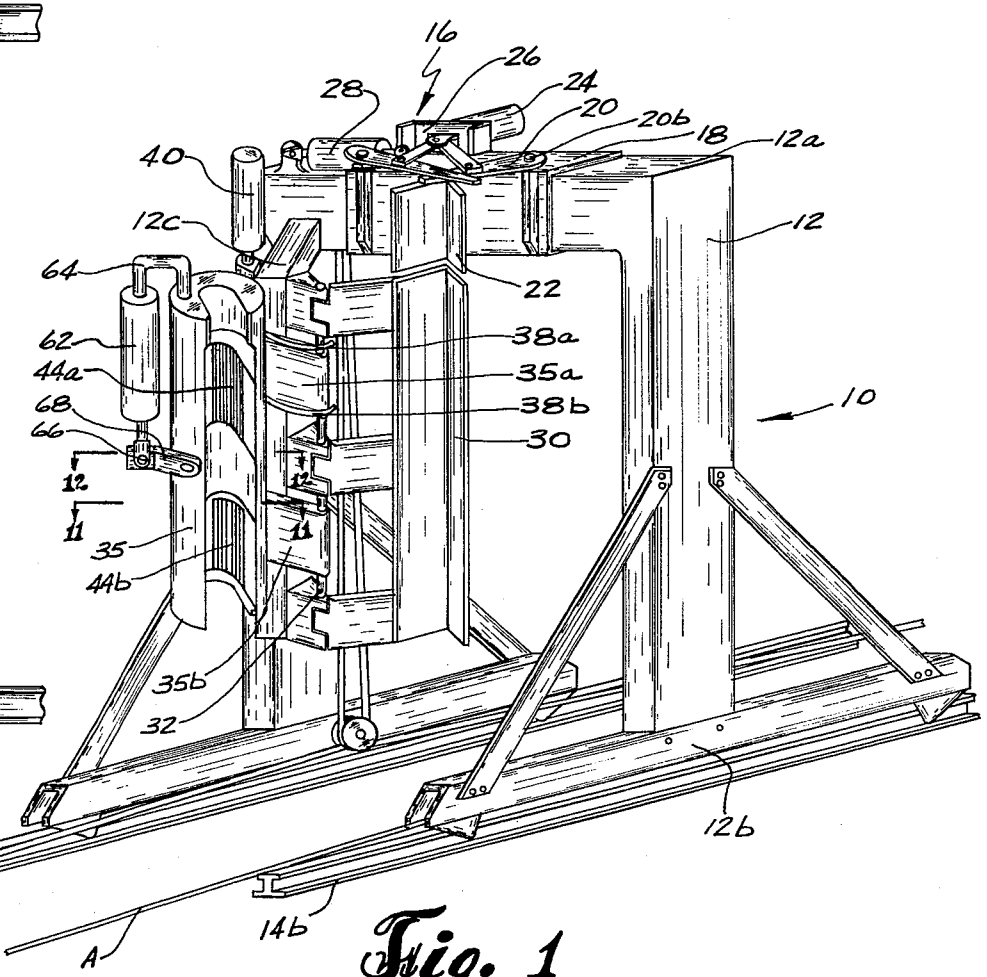
FIG. 1 is a generally perspective view of the pipe handling apparatus of the present invention.

The cradle 22 is in the form of a trough with a "V" cross section, as best seen in FIGS. 1 and 2. The cradle 22 is fixed to the front to the slide 18 to receive a pipe member from that direction. With the locking fingers **20*a* of the clamp 16 in the "open" configuration, a pipe member may be moved to engagement with the cradle 22, or removed from such a position. When so engaged with the cradle 22, the pipe member is constrained from lateral motion generally parallel to the way 12*a*, and from motion toward the back of the pipe handler 10. When it is desired to further confine the pipe member so engaged with the cradle 22, the locking fingers 20*a* may be moved to the "closed" configuration by operation of the fluid pressure assembly 24**.

Figure 3:
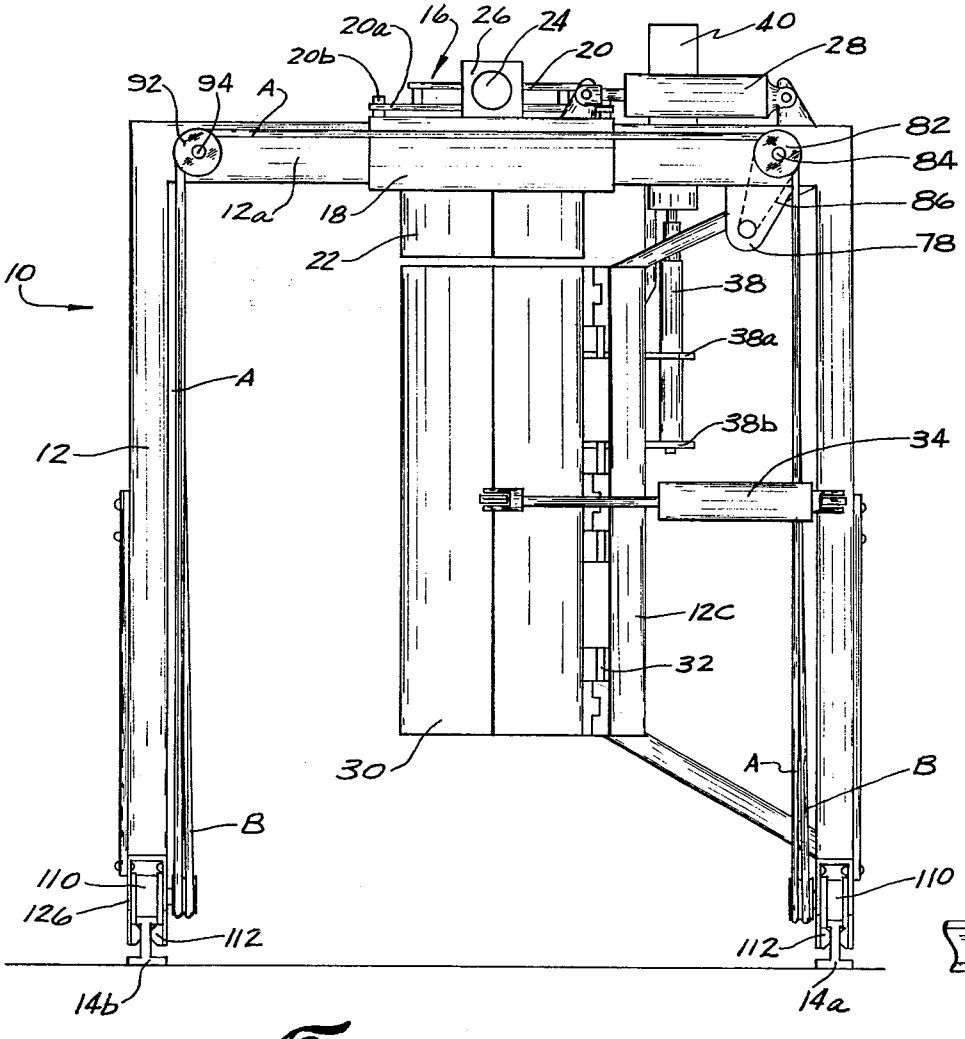
FIG. 3 is a back elevation of the pipe handler showing details of the swing-away guide.

Another fluid pressure piston and cylinder 28 is mounted on the frame 12, with the cylinder of the assembly 28 anchored at one end of the way **12*a*, and the piston of the assembly 28 anchored to the slide 18, as best seen in FIG. 3. Operation of the fluid pressure assembly 28 causes the slide 18 with the clamp assembly 16 attached thereto, to selectively move to any desired position along the way 12*a*. If a pipe member is confined within the cradle 22, and locked therein by the locking fingers 20*a* being in the "closed" configuration, such movement of the slide 18 along the way 12*a*** causes the pipe member to be moved laterally also.

The frame 12 also includes a mounting arm **12*c*, extending generally in the forward direction from one side of the frame. A swing-away guide 30 is supported by the mounting arm 12*c* by a hinge rod 32. An additional fluid pressure piston and cylinder assembly 34 controls the rotation and positioning of the guide 30 about the hinge rod 32. As seen in FIG. 3, the cylinder of the fluid pressure assembly 34 is mounted on the back of one side of the frame 12, and the piston of the fluid pressure assembly 34 is joined to the back of the guide 30. Operation of the fluid pressure assembly 34 selectively swings the guide 30 about the piston rod 32 over a range of positions from behind the way 12*a* to just forward of the way where the guide 30 can be brought into vertical alignment with the cradle 22 when the latter has been appropriately positioned along the way 12*a* by operation of the fluid pressure assembly 28. In the latter case, which is illustrated in FIGS. 1–4, the cradle 22 essentially constitutes a vertical extension of the guide 30**.

This condition is designated the alignment configuration, with the clamp assembly 16, including the cradle 22, being in alignment position.

The mounting arm 12*c* also supports a tong, or torque assembly 35. The tong 35 is also swingable on the mounting arm 12*c* about the hinge rod 32. A fluid pressure piston and cylinder assembly 36, best seen in FIG. 2, controls the rotational positioning of the tong 35 about the hinge rod 32. The cylinder of the fluid pressure assembly 36 is mounted at one side of the frame 12, and the piston of the fluid pressure assembly 36 is joined to the tong 35. As best seen in FIG. 1, the tong 35 is permitted limited vertical motion along the hinge rod 32. Hinge members 35*a* and 35*b* connect the tong 35 to the hinge rod 32, and are interleaved with the hinge connections of the swing-away guide 30 with the hinge rod 32. However, the dimensions of the hinge members 35*a* and 35*b* along the hinge rod 32 are smaller than the corresponding spaces between the hinge connections of the guide 30. Consequently, vertical motion of the hinge members 35*a* and 35*b*, and therefore of the tong 35, along the hinge rod 32 is effected by a lift assembly 38, powered by a fluid pressure piston and cylinder assembly 40. The lift assembly 38 and the related fluid pressure assembly 40 may best be understood by reference to FIGS. 1–4. The cylinder of the fluid pressure assembly 40 is fixed to the mounting arm 12*c*, and the piston of the assembly 40 extends downwardly, being constrained to vertical motion. The lift assembly 38 is joined to, and constitutes a downward extension of, the piston of the fluid pressure assembly 40. A curved upper control arm 38*a* of the lift assembly 38 extends around the front of the mounting arm 12*c* to the vicinity of the hinge rod 32. A similarly shaped lower control arm 38*b*, positioned in the lift assembly 38 below the upper control arm 38*a*, also extends around the front of the mounting arm 12*c* to the vicinity of the hinge rod 32. The two control arms 38*a* and 38*b* are vertically spaced to sandwich the upper hinge member 35*a* of the tong 35. Due to the curvature and the extent of the two control arms 38*a* and 38*b*, these arms so enclose the hinge member 35*a* at all rotational positions of the tong 35. Operation of the fluid pressure assembly 40 causes selective vertical positioning of the lift assembly 38, with its control arms 38*a* and 38*b* moving vertically with the piston of the assembly 40. As the control arms 38*a* and 38*b* are raised, the tong 35 is correspondingly raised by the lower control arm 38*b* driving the hinge member 35*a* upwardly. As the fluid pressure assembly 40 is operated to lower the lift assembly 38, gravity may propel the tong 35 downwardly. Resistance to such downward motion of the tong 35 by an external force may be overcome by the downward driving of the upper control arm 38*a* to lower the tong when desired. Therefore, the tong 35 may be moved generally vertically along the hinge rod 32 as well as rotationally about the hinge rod.

As may best be appreciated by reference to FIG. 2, the tong 35 may be rotated about the hinge rod 32 to face the swing-away guide 30, when the latter is in the alignment configuration. Consequently, when a pipe member is vertically oriented, and confined within the guide 30 in the alignment configuration, the tong 35 may be moved around the hinge rod 32 by the fluid pressure assembly 36 to also engage the pipe member. As will be described more fully hereinafter, the pipe handler 10 may be so positioned over a well bore so as to contact, in the guide 30, in the alignment configuration, the top end of the pipe member protruding up from the well bore as part of a drill string. Then, the bottom portion of a second pipe member may be aligned with this drill string pipe member within the guide 30, and the tong 35 may engage both pipe members at the same time.

The tong 35 is a powdered torque device, designed to impart torque to pipe members engaged therein. Details of the construction and operation of the tong 35 may be appreciated by reference to FIGS. 1, 11 and 12. The tong 35 is constructed generally in the form of an elongate, tubular housing 42 with a side opening 42*a* that faces the swing-away guide 30 when both the tong and the guide are moved adjacent each other as described hereinbefore. Along its cylindrical axis, the housing 42 contains an upper, or first, gripping device 44*a*, and a lower, or second, gripping device 44*b*. The two gripping devices 44*a* and 44*b* are essentially alike, and only the lower gripping device 44*b* is described in detail herein.

Figure 11:
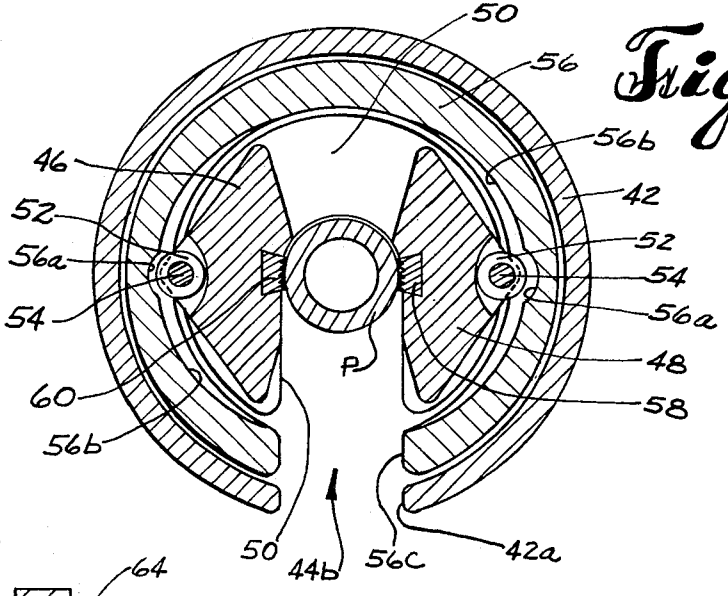
FIG. 11 is a cross section taken along line 11—11 of FIG. 1, and showing details of a gripping device.

As best seen in FIG. 11, the gripping device shown generally at 44*b* includes a pair of cam shoes 46 and 48, each mounted by a T-slot union (not visible) on a slip mount 50. These unions permit limited radial motion of the cam shoes 46 and 48 relative to the slip mounts 50. The radially outermost portions of cam shoes 46 and 48 feature one or more rollers (only one visible) 52, joined to the cam shoes by shafts 54. A camming collar 56 partially surrounds the cam shoes 46 and 48. The radially inner face of the camming collar 56 features a pair of oppositely positioned depressions 56*a* which are centered on arcuate camming surfaces 56*b*. As will be described in detail hereinafter, the slip mount 50 and the camming collar 56 are free to rotate about the central axis of the tong 35 relative to the housing 42, and relative to each other. When the camming collar 56 is rotated relative to the slip mount 50, the camming surfaces 56*b* contact the roller 52, which then roll along the arcuate surfaces. When the camming collar 56 is rotated, relative to the slip mount 50 the rollers 52 contact and roll along the arcuate surfaces 56*b*. The design of the arcuate surfaces 56*b* is such that, as the camming collar 56 is turned further rotationally away from the position illustrated in FIG. 11, wherein the rollers 52 are aligned with the depressions 56*a*, the arcuate surfaces 56*b* urge the rollers, and therefore the cam shoes 46 and 48, radially inwardly. This motion forced on the cam shoes occurs whether the camming collar is rotated clockwise, or counter-clockwise relative to the housing 42 as viewed in FIG. 11. The radially inner face of each cam shoe 46 and 48 features a dovetail slot 58 in which is inserted a slip die 60. The slip dies are equipped with alternating grooves and ridges running parallel to the longitudinal central axis of the tong 35.

When the slip mount 50 is in the position illustrated in FIG. 11, with the rollers 52 aligned with the depressions 56*a*, a pipe member P may be inserted within the housing side opening 42*a*. The camming collar 56 also features an opening 56*c* aligned with the housing side opening 42*a*. The slip mount features a similar opening 50*a* which is aligned with the camming collar opening 56*c* and the housing opening 42*a* when the rollers 52 are aligned with the depressions 56*a*. Then, a pipe member P may be inserted through these openings to the interior of the slip mount 50 as shown in FIG. 11, or withdrawn therefrom. When the camming collar 56 is made to rotate as described hereinbefore, and the arcuate surfaces 56*b* urge the cam shoes 46 and 48 radially inwardly, the slips 60 then grip the pipe member P by the ridges of the slips pressing into the outer surface of the pipe member P. Continued rotation of the camming collar 56 in the same sense results in torque being imparted from the camming collar through the cam shoes 46 and 48 and the slip die 60 to the pipe member P.

Figure 12:
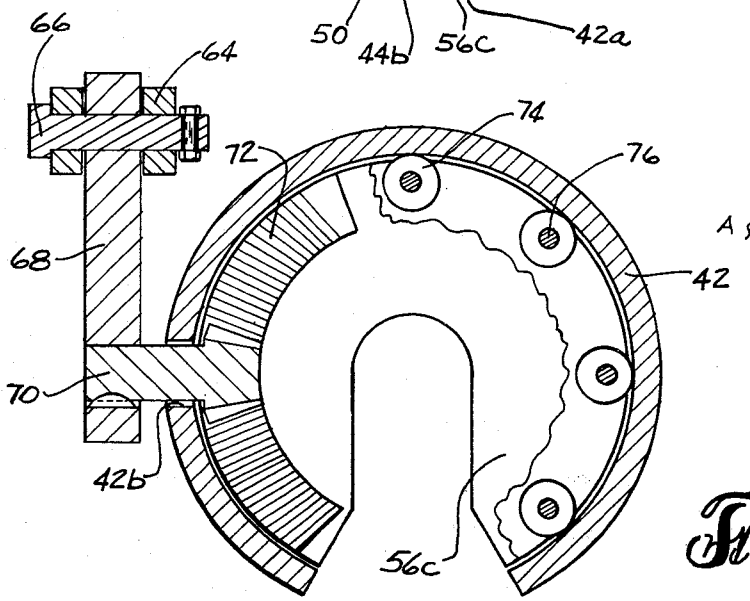
FIG. 12 is a cross section taken along line 12—12 of FIG. 1, illustrating the gear arrangement for rotating the two gripping devices in opposite senses.

The two gripping devices 44*a* and 44*b* each possess a separate slip mount 50 and camming collar 56. Furthermore, these gripping devices 44*a* and 44*b* are fitted into the tong 35 such that when the camming collar 56 of one gripping device is caused to rotate in one sense, the camming collar of the other gripping device rotates in the opposite sense. The rotations of both camming collars 56 may also be mutually reversed. A fluid pressure piston and cylinder assembly 62 is used to selectively rotate the two camming collars 56 of the gripping devices 44*a* and 44*b*. The fluid pressure assembly 62 is mounted on the exterior of the tong 35, with the cylinder of the assembly 62 fixed by a bracket 64 to the housing 42 of the tong. The piston of the fluid pressure assembly 62 extends downwardly to be joined by a hinge pin 66 to a lever 68 along the side of the tong 35. As best seen in FIG. 12, the lever 68 is rotationally fixed to the shaft of a beveled pinion gear 70. The tooth portion of the pinion gear 70 is located within the housing 42, while the shaft of the gear 70 extends outwardly through an opening 42*b* in the housing. As the fluid pressure assembly 62 is operated, an upward motion of the piston causes the lever 68 to rotate upwardly in a clockwise sense as seen in FIG. 1. Such a rotation of the lever 68 results in a rotation of the pinion gear 70. A downward motion of the piston of the fluid pressure assembly 62 causes a downward or counterclockwise rotation of the lever as viewed in FIG. 1, with a resulting reversal of the rotation of the pinion gear 70. In this way, by operation of the fluid pressure assembly 62, the pinion gear 70 may be selectively rotated about its axis in either sense.

Within the housing 42, the pinion gear 70 meshes with a pair of bevel gear sections 72 (only one visible), each of which is mounted on an adjacent surface of an end plate 56*c* fixed to a camming collar 56. Thus, the bevel gear section 72 shown in FIG. 12 is fixed to the end plate 56*c* at the top of the camming collar 56 of the lower gripping device 44*b*. A similar bevel gear section 72 (not shown) is located immediately above the pinion gear 70 as shown in FIG. 12, and fixed to the end plate 56*c* at the bottom of the camming collar 56 (not shown) of the upper gripping device 44*a*. As shown in the broken portion of FIG. 12, each camming collar 56 is fitted with a plurality of rollers 74 mounted on shafts 76, and positioned to ride along the interior surface of the housing 42 as the camming collars are rotated relative thereto. Similarly, the bottom of the camming collar 56 of the lower gripping device 44*b*, and the top of the camming collar 56 of the upper gripping device 44*a* are fitted with appropriate bearings (not shown) to roll against appropriate shoulder surfaces of the housing 42 to prevent longitudinal motion of the two gripping devices relative to the housing. Consequently, when the fluid pressure assembly 62 is operated to raise the lever 68, the upper gripping device is rotated counterclockwise when viewed from above in FIG. 1, and the lower gripping device is rotated clockwise. When the fluid pressure assembly 62 is operated to lower the lever 68, the upper gripping device is rotated in a clockwise sense, and the lower gripping device is rotated in a counterclockwise sense.

The ability of the tong 35 to be selectively positioned vertically along the hinge rod 32 by operation of the fluid pressure assembly 40 as described hereinbefore permits the two gripping devices 44*a* and 44*b* to be applied at selected points on pipe members. As best seen in FIG. 11, the cam shoes 46 and slip dies 60 fit about, and grip, the long shaft of the pipe member P, but the upset end of such a pipe member has too large a cross section to fit between the cam shoes. Thus, the tong 35 is vertically positioned so that the upset end of a pipe member P, to which torque is to be applied, passes into the tong housing 42 between the two pipe gripping devices 44*a* and 44*b*.

When a pipe member is confined in the swing-away guide 30 in the alignment configuration, and the tong 35 is advanced to engage the pipe member also, operation of the fluid pressure assembly 62 results in torque being imparted through the gripping device 44*a* or 44*b* which engages the pipe member P. When a pipe member protruding upwardly through the derrick floor is engaged by the lower gripping device 44*b*, and a pipe member suspended from above is engaged by the upper gripping device 44*a*, the two pipe members may then experience torque in opposite senses at the same time imposed by the tong 35. Consequently, by causing the male and female threaded ends of such two pipe members engaged by the tong 35 to contact each other between the two gripping devices 44*a* and 44*b*, operation of the fluid pressure assembly 62 may be effected to threadedly join the two pipe members. Similarly, two pipe members whose ends are threadedly joined together may be disengaged, or broken, by imparting torque to one pipe member with the lower gripping device 44*b* and torque in the opposite sense to the other pipe member with the gripping device 44*a*. Details of such operations will be discussed more fully hereinafter.

Figure 13:
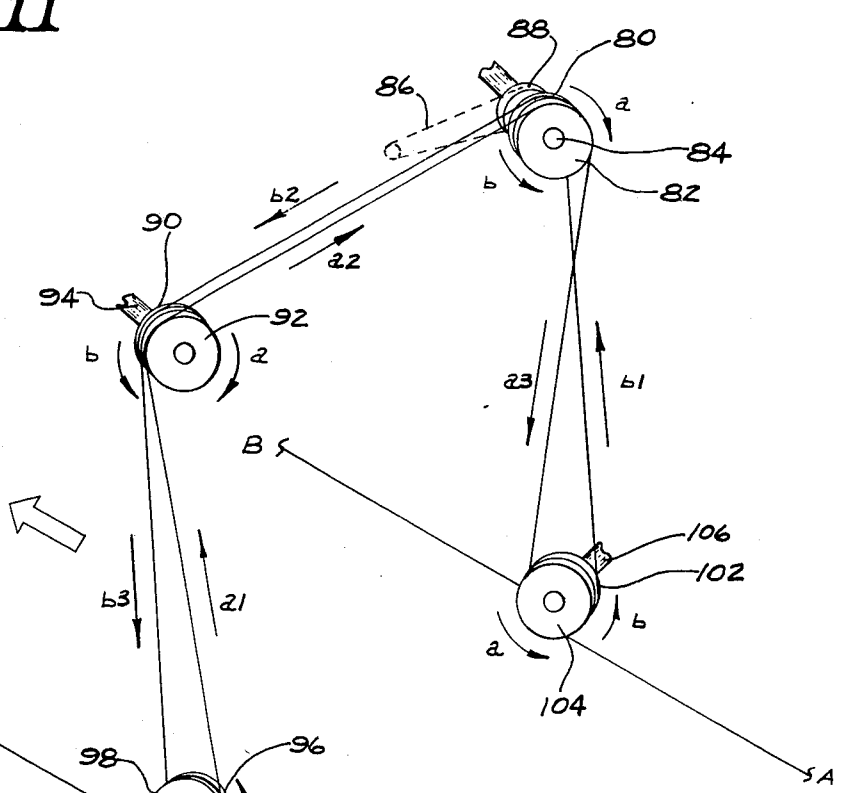
FIG. 13 is a schematic illustration of the cable and sheave assembly used to propel the pipe handler about the floor of the derrick or mast assembly.

The frame, and therefore, the pipe handler 10 in general, may be propelled along the rails 14*a* and 14*b* in any suitable manner. However, FIGS. 1–4 and FIG. 13 illustrate one particular manner of moving the frame 12 along the rails 14*a* and 14*b* by using a cable and sheave system. Two cables A and B are employed. As indicated in FIG. 13, cable A is anchored to the derrick floor or the rail 14*b*, or in some other suitable manner, forward of the frame 12 along the rail 14*b*, and is anchored at the other end of the cable along the rail 14*a* behind the frame 12. Similarly, cable B is anchored forward of the frame 12 along the rail 14*a* at one end, and backward along the other rail 14*b*. The anchoring of the cables A and B may be in any suitable manner, but may include tensioning devices (not shown) to keep the cables relatively taut at all times. A motor 78 is mounted on the frame 12 below the way 12*a* (see FIG. 3). A pair of driven sheaves 88 and 82 are mounted on a differential mechanism 84, which is coupled to the motor 78 by a drive belt, or chain, 86 and a drive wheel 88. When the motor causes the drive wheel 88 to rotate in one sense, the differential mechanism 84 imparts torque to the driven sheaves 80 and 82 in different senses so that the sheaves rotate in mutually opposite directions. The motor 78 may be reversed to cause each of the sheaves 80 and 82 to reverse their rotational motions. At the opposite end of the way 12*a*, a pair of free-wheeling sheaves 90 and 92 are mounted on a shaft 94. Toward the bottom of the frame 12, on the inner sides of the trollies 12*b*, are located additional free-wheeling sheaves 96 and 98 on a shaft 100, and sheaves 102 and 104 mounted on a shaft 106. Starting from the region of the forward end of rail 14*b*, cable A extends toward the frame 12 and passes under and around the sheave 98, up the back of the frame 12 and over the sheave 92, along the way 12*a* and over the driven sheave 82, down to the sheave 104 and back along the rail 14*a* behind the frame 12. Cable B extends from the region toward the back of the rail 14*b* toward the frame 12, under and around the sheave 96 up to and over the sheave 90, along the way 12*a* and over the driven sheave 80, down to and under the sheave 102 and along the forward direction of the rail 14*a*.

Operation of the motor 78 to rotate the drive wheel 88 causes, for instance, the driven sheave 82 to rotate clockwise as indicated by the accompanying arrow a as viewed in FIG. 13, and the driven sheave 80 to rotate counterclockwise as indicated by the accompanying arrow *b*. The rotation of these two sheaves 80 and 82 causes the two cables A and B to be drawn around the sheaves 98, 92, 104, and 102, 90, 98, respectively, in the direction indicated by all arrows, *a* and *b*, respectively. Consequently, relative to the frame 12, the cable A is pulled up from the sheave 98 in the direction indicated by the arrow *a*1, and over the sheave 92 and along the way 12*a* in the direction indicated by the arrow *a*2, and is fed downwardly to the sheave 104 in the direction indicated by the arrow *a*3. At the same time, the cable B is pulled around the sheave 102 up to the drive sheave 80 as indicated by the arrow *b*1, and is fed along the way 12*a* in the directiion of the arrow *b*2, and down from the sheave 90 to the sheave 96 in the direction indicated by the arrow *b*3. In this fashion, all of the sheaves are driven, or caused to rotate, in the directions indicated by their accompanying arrows *a* or *b* as noted hereinbefore. Then, the frame 12 pulls itself in the forward direction by drawing in the cables A and B from that direction along the rails 14*b* and 14*a*, respectively, and feeding the cables A and B backwardly along the rails 14*a* and 14*b*, respectively. When the motor 78 is stopped, the pulling on the cables A and B ceases, and the frame 12 ceases to be propelled. By reversing the direction of rotation of the motor 78, the direction of rotation of the driven sheaves 80 and 82 are reversed, and the frame 12 is propelled backwardly by pulling on the cables A and B along the backward directions of the rails 14*a* and 14*b*, respectively, and feeding the cables A and B in the forward direction along the rails 14*b* and 14*a*, respectively. In this fashion, the frame 12, and the pipe handler 10 in general, may be selectively moved along the path defined by the track system which includes the rails 14*a* and 14*b*. With such movement of the frame 12, a pipe member confined within the cradle 22, and even constrained by the latch system 20, will be propelled forwardly or backwardly with the frame 12. Thus, such motion of the frame 12 combined with the motion of the clamp assembly 16 along the way 12*a* permits selective manipulation of a pipe member in two generally mutually orthoginal directions.

Figure 4:
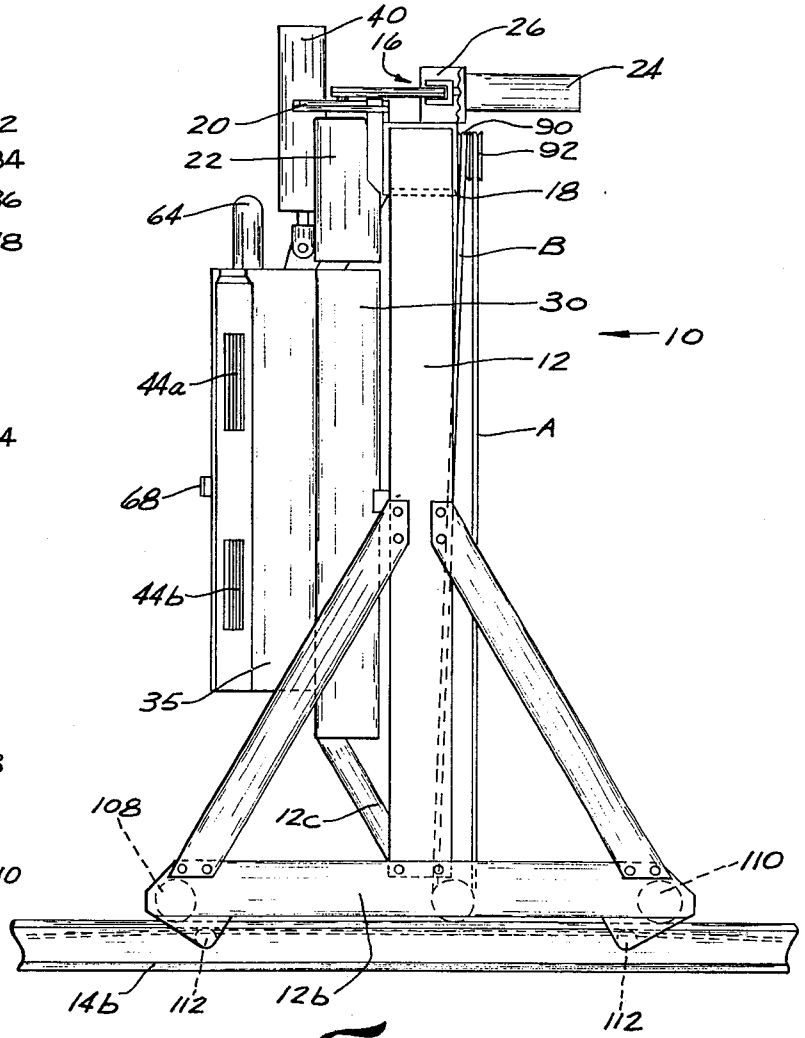
FIG. 4 is a side elevation of the pipe handler.

Details of the trolleys 12*b* may be appreciated by reference to FIGS. 1, 3 and 4. Each trolley 12*b* includes a forward wheel 108 and a rearward wheel 110, both such wheels riding on the top surface of the corresponding rail 14*a* or 14*b*. Just to the rear of each forward wheel 108, and forward to each rear wheel 110, are a pair of control bearings 112 riding along the sides of the uprights of the rails 14*a* and 14*b*, and below the top cross members of the rails. The control bearings 112 thus serve to grip the rails from the bottom and sides, tending to prevent the trolleys 12*b* from derailing. It will also be appreciated that the location of the cables A and B generally within and along the rails 14*a* and 14*b* tends to permit the frame 12 to move along the rails without the cable propulsion mechanism generating forces lateral to the frame, which might otherwise pose a derailing danger.

It will be appreciated that all the fluid pressure assemblies may be gas or liquid powered. A single source, or multiple sources, of such fluid may be used with actual controls of the fluid pressure applied to the fluid pressure assemblies conveniently arranged at one location. Furthermore, whenever such a fluid pressure piston and cylinder assembly is described herein a motor, such as a fluid operated or electric motor, may be used instead as a power source.

Further details of the mode of operation of the pipe handler 10, as well as details of the method of the present invention, may be appreciated by reference to FIGS. 5–10. There, the pipe handler 10 is shown schematically on the floor 114 of a derrick or mast assembly (not shown). The rails (only 14*b* visible) straddle a hole in the floor leading to the well bore, as well as pertinent equipment situated just above the well bore, designated generally at W. The path defined by the track system including rails 14*a* and 14*b* permits the pipe handler to be moved from behind the well W, over the well and forward toward one side of the floor 114 at which pipe members may be raised or lowered to or from the floor level. The trough 116 of a pipe handling system is shown being used to assist the movement of pipe members. Such a pipe handling system is described in U.S. Pat. No. 3,916,500.

Figure 5:
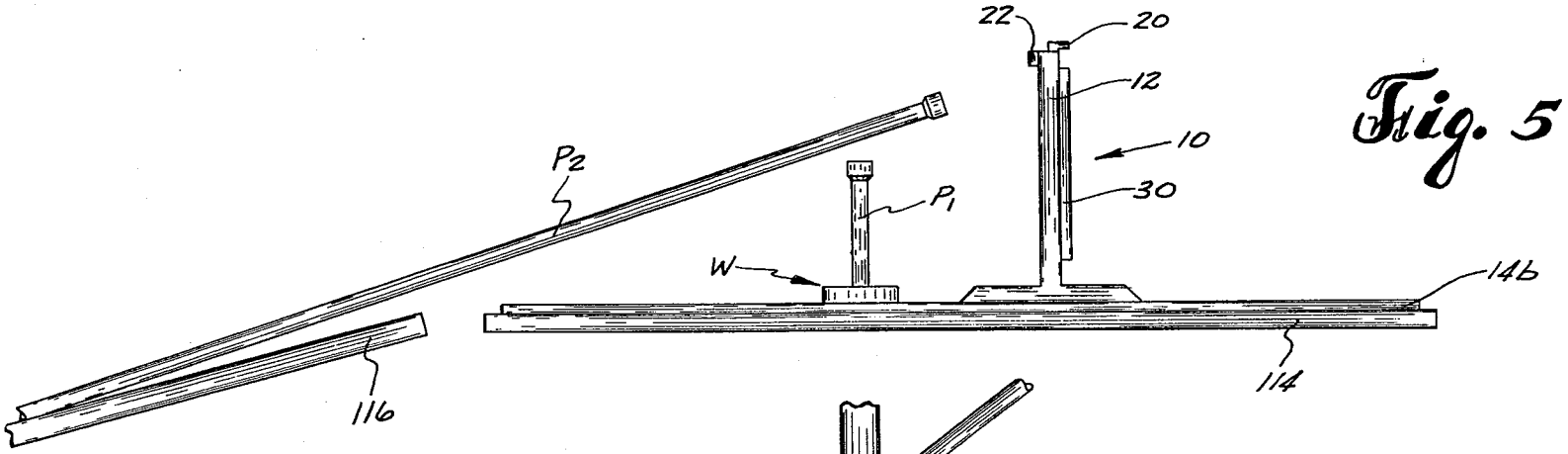
FIG. 5 is a partially schematic side elevation of the pipe handler located on the floor of a derrick or mast assembly, prior to the pipe handler being advanced to engage a pipe member for manipulation.
Figure 6:
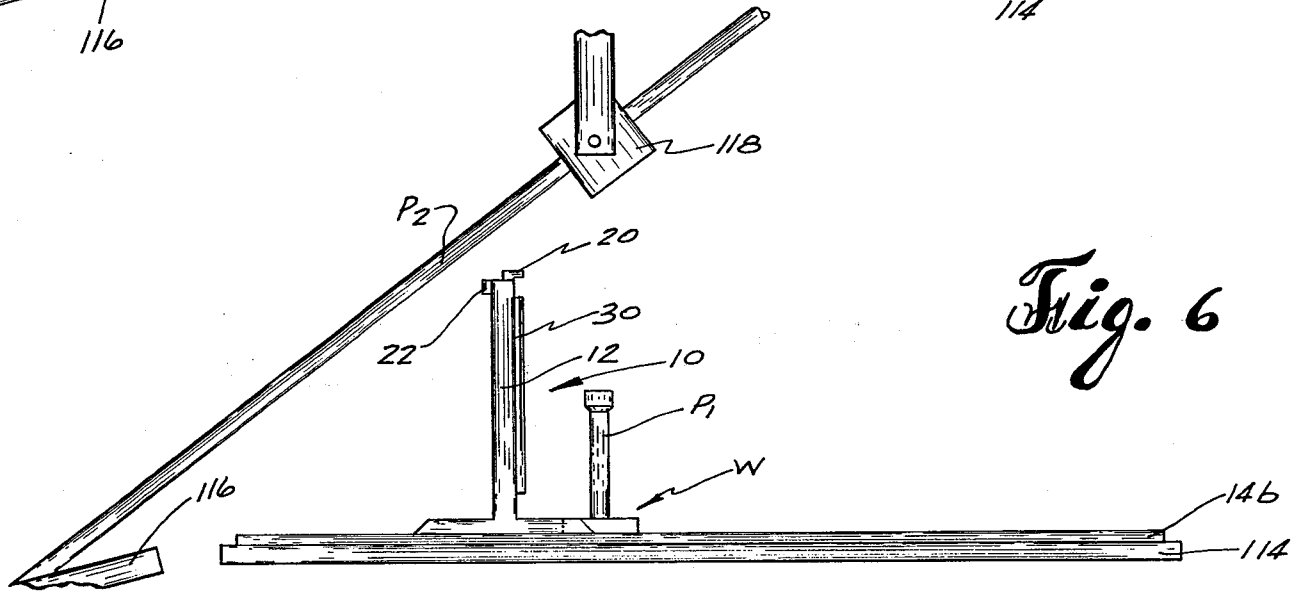
FIG. 6 is a view similar to FIG. 5 showing the pipe member supported by an elevator.
Figure 7:
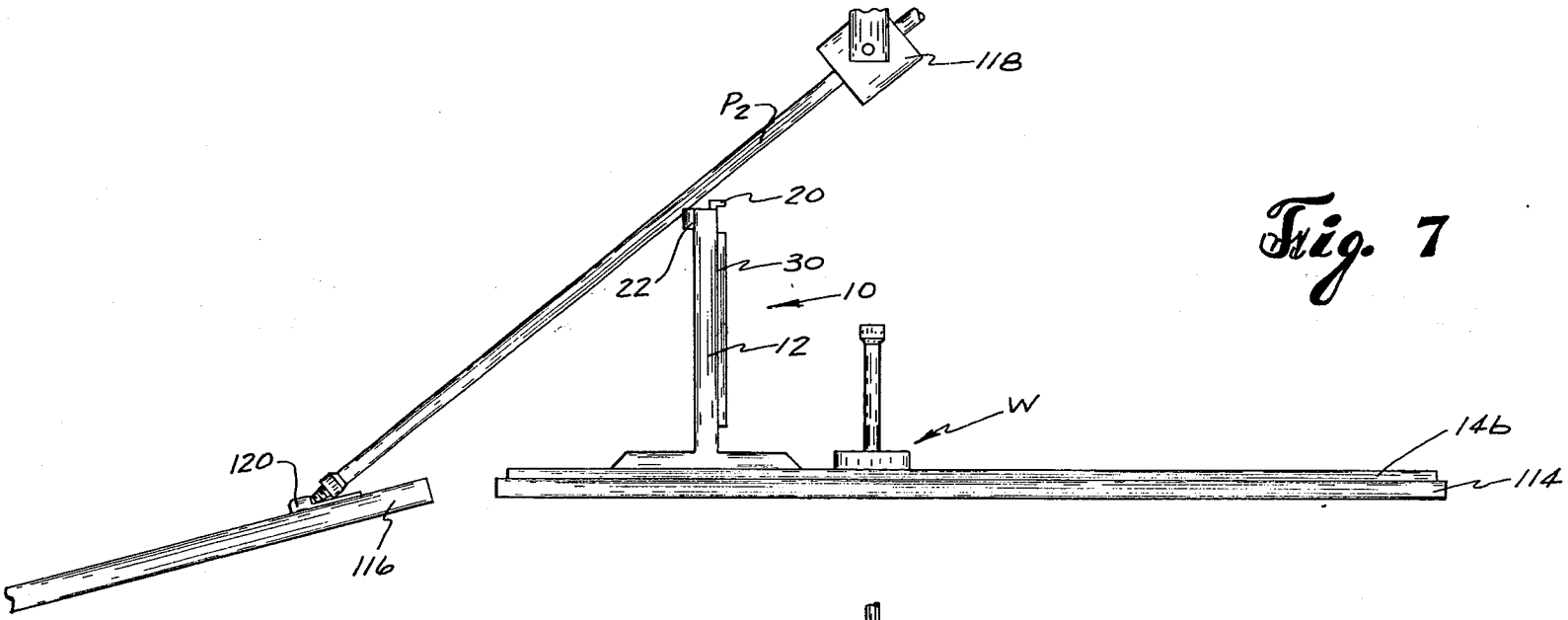
FIG. 7 illustrates the pipe handler of FIG. 6 with the cradle of the clamp assembly constraining the pipe member.
Figure 8:
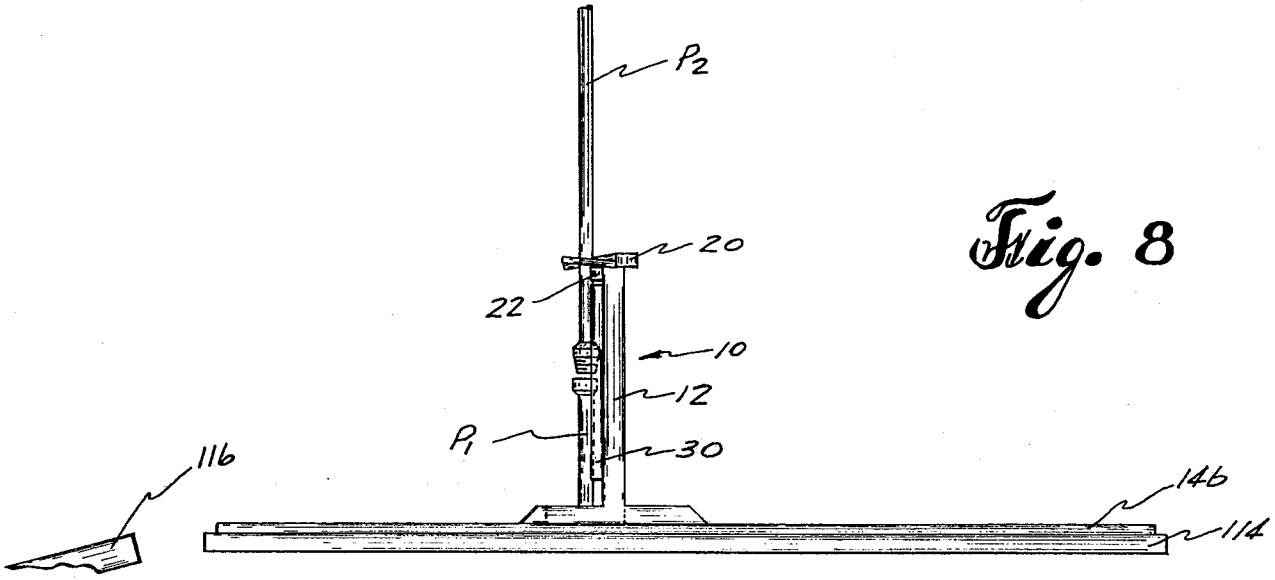
FIG. 8 shows the pipe member of FIG. 7 positioned to be joined to the pipe string.
Figure 9:
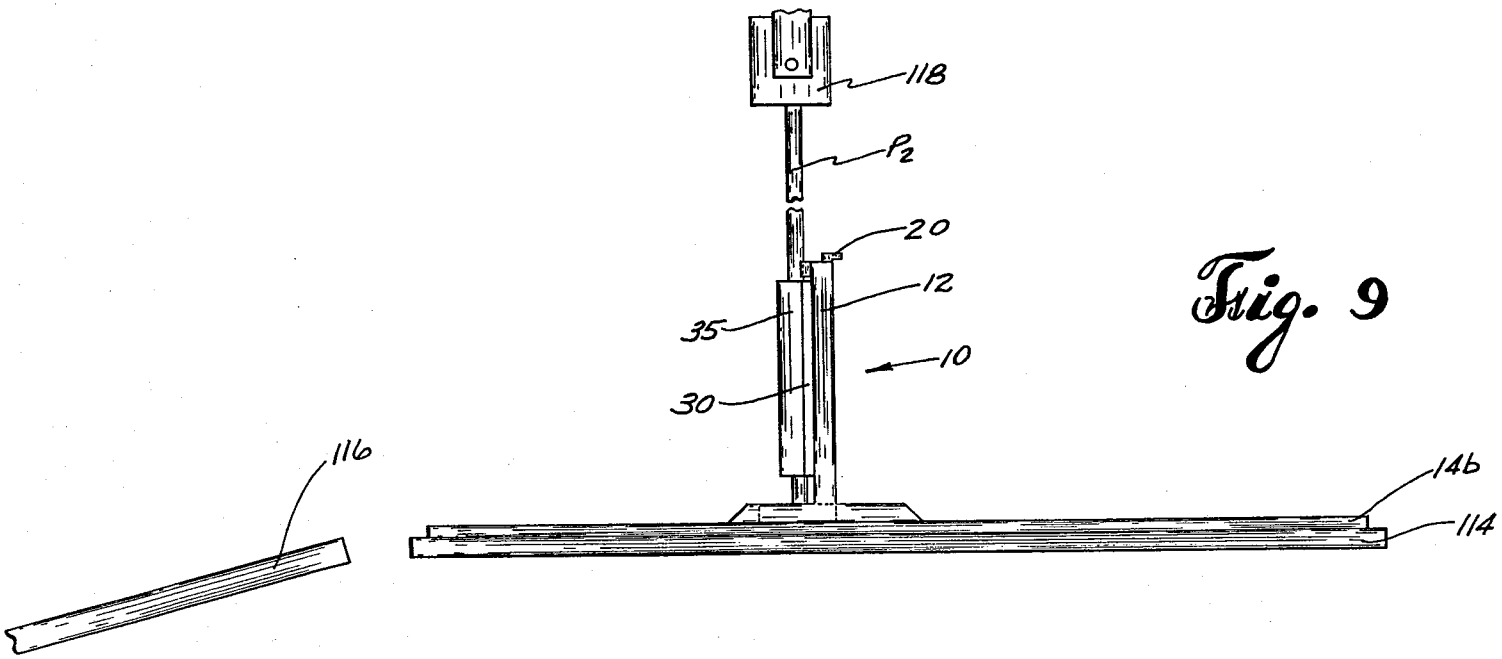
FIG. 9 shows the tong device of the pipe handler in position to make up the threaded joint between the pipe member and the pipe string.

In FIG. 5, the female threaded box of the upset end of a pipe member P1, which may be the top member of a drill string, is shown protruding from the well above the floor 114, and a second pipe member P2 is shown being advanced up the trough 116. At this stage of the operation, the pipe handler 10 is withdrawn out of the way behind the well W. In FIG. 6, the pipe member P2 is shown engaged in an elevator 118 that is supported by the derrick or mast assembly (not shown). The pipe handler 10 has been moved forwardly in preparation for engaging the pipe handler P2. Such engagement of the pipe member P2 by the pipe handler 10 is shown in FIG. 7. At this point, a lug 120 has pushed the male threaded pin end of the pipe member P2 adjacent the end of the trough 116, and the cradle 22 has engaged the pipe member P2. As the elevator 118 lifts the upper end of the pipe member P2, the lower end of that pipe member swings free of the trough 116, guided by the cradle 22. The pipe handler 10 is propelled backwardly along the rails 14*a* and 14*b* by operation of the motor 78 to appropriately pull on the cables A and B, while the fluid pressure assembly 28 is operated to move the slide 18 along the way 12*a* until the cradle 22 has arrived at the alignment position. The rails 14*a* and 14*b* have been so positioned on opposite sides of the well at W that, when the cradle 22 has been moved into the alignment position, the pipe member P2 confined therein and supported by the elevator 118 will by generally in a vertical plane containing the well head at W. The frame 12 is moved along the rails 14*a* and 14*b*, and the slide 18 is moved along the way 12*a*, as the elevator 118 continues to raise the second pipe member P2 until the second pipe member is oriented generally vertically and positioned directly above the first pipe member P1 as shown in FIG. 8. Then, the latch 20 is operated to cause the locking fingers 20*a* to close about the second pipe member P2, and the swing-away guide 30 is moved forwardly to the alignment configuration by operation of the fluid pressure assembly 34. The result is that the guide 30 engages both the first pipe member P1 and the second pipe member P2, and the second pipe member P2 is constrained by the guide 30, the cradle 22, and the latch 20 to a substantially vertical orientation in alignment along a common axis with the first pipe member P1. The elevator 118 is then moved to lower the second pipe member P2 until the two pipe members P1 and P2 contact. Then, as illustrated in FIG. 9, the tong 35 is swung around to engage both pipe members P1 and P2 by operation of the fluid pressure assembly 36. The upper gripping device 44*a* then encloses the second pipe member P2 and the lower gripping device 44*b* encloses the first pipe member P1. If necessary, the fluid pressure assembly 40 is activated to adjust the vertical position of the tong 35 by moving the lift assembly 38 up or down to align the two gripping devices 44*a* and 44*b* to so engage the two pipe members P2 and P1, respectively, with the upset end of the lower pipe member P1 placed between the two gripping devices. Operation of the fluid pressure assembly 62 is effected to rotate the two camming collars 56 in opposite senses, causing the slips 60 of the upper gripping device 44*a* to transmit torque to the second pipe member P2 and the slips 60 of the lower gripping device 44*b* to transmit torque to the first pipe member P1. The two gripping devices 44*a* and 44*b* transmit torque to the pipe member P2 and P1, respectively, in opposite sense to cause these two pipe members to be threaded together.

Figure 10:
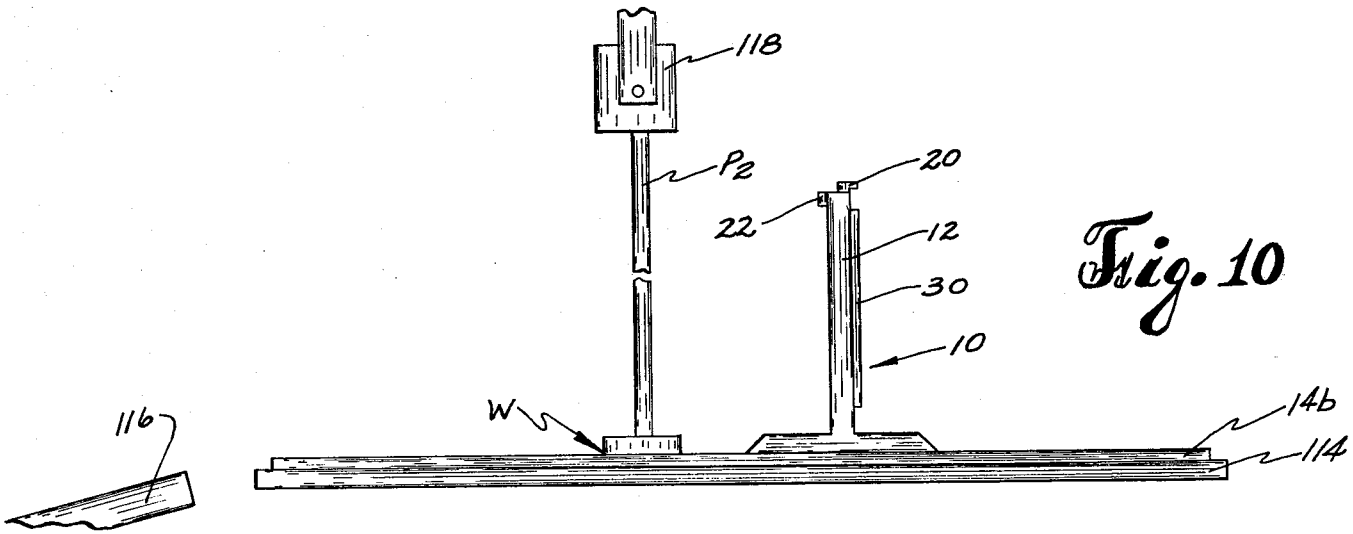
FIG. 10 shows the pipe member being lowered into the well bore with the pipe handler withdrawn from the well area.

It will be appreciated by reference to FIGS. 11 and 12 that one stroke of the piston of the fluid pressure assembly 62 may rotate the camming collars 56 approximately 30° or 45°, depending in part on the arc length of the bevel gears 72. As the piston of the fluid pressure assembly 62 is returned to its middle position in which the rollers 52 are aligned with the depressions 56*a* within the housing 42, the arcuate surfaces 56*b* permit the cam shoes 46 and 48, and the slip dies 60, to be radially withdrawn from torque-transmitting engagement with the pipe members P1 and P2. Consequently, repeated strokes by the piston of the fluid pressure assembly 62 between the neutral position and one extreme position may be employed to continue rotating the two pipe members P1 and P2 in opposite directions until the threaded joint therebetween is completed. Then, the tong 35 may be withdrawn from the pipe members P1 and P2, and the frame 12 moved backwardly along the rails 14*a* and 14*b*. As an alternative, the pipe handler 10 may be so disengaged from the pipe members P1 and P2 after one or a few of such strokes of the piston of the fluid pressure assembly 62 to merely start the threaded joining of the two pipe members P1 and P2. In that case, the joint between the two pipe members P1 and P2 may be tightened by other means known in the art. In any event, once the joint between the pipe members P1 and P2 is completed, the elevator 118 may be operated to lower the drill string with the newly-added second pipe member P2 down into the well bore, as shown in FIG. 10. When the drill string has been lowered into the well bore until only the top end of the second pipe member P2 protrudes above the floor 114, the elevator 118 may release the second pipe member, and an additional pipe member may be advanced up the trough 116 to repeat the pipe manipulation process beginning as shown in FIG. 5.

The pipe handler 10 may be used in the withdrawal of pipe members from the well W generally by a reversal of the steps illustrated in FIG. 5–10. Thus, the elevator 118 may engage a pipe member P2 at the top of the drill string to raise the drill string until the joint between the pipe member P2 and the pipe member P1 is located just above the floor 114. Then, the pipe handler 10 is advanced along the rails 14*a* and 14*b* until the swing-away guide 30, in the alignment position engages both pipe members P1 and P2. The second pipe member P2 is then also confined by the cradle 22. The latch 20 may be activated to further constrain the second pipe member P2 within the closed locking fingers 20*a*. The tong 35 is then swung around to engage the pipe members P1 and P2 as shown in FIG. 9, and the lift assembly 38 activated to adjust the height of the tong, as described hereinbefore, if required. The fluid pressure assembly 62 is then operated in the opposite direction to cause the gripping devices 44*a* and 44*b*, acting on the second pipe member P2 and the first pipe member P1, respectively, to break, or unthread, the threaded joint between the two pipe members. Then, the tong 35 is swung out of the way, and the second pipe member P2 raised clear of the first pipe member P1 as shown in FIG. 8. The latch is activated to open the locking fingers 20*a*. The frame 12 is then pulled forward along the cables A and B by operation of the motor 78, and the fluid pressure assembly 28 is operated, if needed, to move the second pipe member laterally to align it with the trough 116. As the frame 12 approaches the edge of the floor 114 toward which is located the trough 116, the elevator 118 lowers the second pipe member P2. The bottom end of the second pipe member P2 is made to clear the edge of the floor 114 by the selective forward movement of the frame 12. Then, the second pipe member P2 is placed against the lug 120, which has been moved toward the upper end of trough 116 as illustrated in FIG. 7. At this point, the frame 12 may be propelled backwardly away from the second pipe member P2, with total control of the second pipe member now residing in the lug 120, the trough 116, and the elevator 118, as illustrated in FIG. 6. Finally, the second pipe member P2 may be returned completely to the trough 116, for further disposal and storage. Once the frame 12 has been moved to the backward side of the well W, the elevator can again be lowered to grasp the top of the pipe member P1 protruding from the well W to repeat the process begun in FIG. 10. Thus the pipe handler 10 may be used to manipulate pipe members in the process of inserting pipe in the bore of the well W, as well as in the process of removing pipe members therefrom and returning them to storage.

It will be appreciated that, in the process of removing pipe members from the well, the pipe handler may be used to loosen the threaded joints between adjacent pipe members in the drill string. Then, the unthreading of such a joint may be completed by other means known in the art before the pipe handler 10 continues to be used to manipulate such pipe members in their eventual return to storage. Also, the present invention may be used in the manipulation of pipe stands composed of two or more pipe members threadedly joined together, and otherwise treated as a single length of pipe. In such case, torque is applied by the tong 35 of the pipe handler 10 to thread or unthread joints at the ends of the pipe stands, rather than to so act upon joints at the ends of each individual pipe member. Furthermore, while the present invention has been described in relation to manipulating pipe members in operations on a well, the invention may also be used in manipulating casing members, or pipe members in general for purposes other than operating on a well.

The foregoing disclosure and description of the invention is illustrative and explanatory thereof, and various changes in the method steps as well as in the details of the illustrated apparatus may be made within the scope of the appended claims without departing from the spirit of the invention.

It is claimed:

1. Apparatus for manipulating elongate tubular members comprising:

a. guide means, selectively engagable with said tubular members, for substantially constraining motion of said tubular members, relative to said guide means, to longitudinal motion and rotation about their axes of cylindrical symmetry;

b. first power means for selectively moving said guide means into and out of engagement with said tubular members;

c. way means, oriented generally perpendicular to said guide means when said guide means is so engaging one said tubular member;

d. clamp means, selectively engagable with a said tubular member, constrained to movement along said way means, for selectively engaging a said tubular member and moving said tubular member between a first position, wherein said tubular member may be engaged and substantially constrained by said guide means, and a second position, wherein saib tubular member is clear of said guide means;

e. second power means for selectively moving said clamp means, and any said tubular member engaged thereby, along said way means between said first position and said second position;

f. torque means, selectively engagable with said tubular member in said first position, for selectively applying torque to said tubular member about its axis of cylindrical symmetry; and g. third power means for selectively activating said torque means to apply said torque to said tubular member.

2. Apparatus for manipulating tubular members as defined in claim 1 further comprising frame means, on which said way means is located, movable along a path generally perpendicular to the orientation of said way means and generally perpendicular to said guide means when said guide means is engaging one said tubular member.

3. Apparatus for manipulating tubular members as defined in claim 2 further comprising fourth power means for selectively moving said frame means along said path.

4. Apparatus for manipulating tubular members as defined in claim 3 wherein said path is defined by track means.

5. Apparatus for manipulating tubular members as defined in claim 1 wherein said torque means is movable, parallel to said guide means when said guide means is engaging one said tubular member, to selectively engage and apply said torque to said tubular member at selected positions along said tubular member.

6. Apparatus for manipulating tubular members as defined in claim 5 further comprising fourth power means to selectively move said torque means along said tubular member.

7. Apparatus for manipulating tubular members as defined in claim 6 further comprising fifth power means for selectively moving said torque means into and out of engagement with said tubular member.

8. Apparatus for manipulating tubular members as defined in claim 5 wherein said torque means comprises:

a. first gripping means and second gripping means, disposed at two different positions along said torque means, by which said torque means may simultaneously engage and apply torque to two tubular members, said first gripping means so acting on a first such tubular member in said first position and said second gripping means so acting on a second such tubular member; and b. differential means linking said third power means to said first and second gripping means, for simultaneously effecting application of torque by said first gripping means to said first such tubular member in one rotational sense and by said second gripping means to said second such tubular member in the opposite rotational sense.

9. Apparatus for manipulating tubular members as defined in claim 8 further comprising frame means, on which said way means is located, movable along a path generaly perpendicular to the orientation of said way means and generally perpendicular to said guide means when said guide means is engaging one said tubular member.

10. Apparatus for manipulating tubular members as defined in claim 9 further comprising fourth power means for selectively moving said frame means along said path.

11. Apparatus for manipulating tubular members as defined in claim 10 wherein said path is defined by track means.

12. Apparatus for manipulating tubular members as defined in claim 11 further comprising fifth power means to selectively move said torque means along said tubular member.

13. Apparatus for manipulating tubular members as defined in claim 12 further comprising sixth power means for selectively moving said torque means into and out of engagement with said tubular member.

14. Apparatus for manipulating tubular members as defined in claim 13 further comprising seventh power means for actuating said clamp means to selectively engage and disengage said tubular member.

15. Apparatus for manipulating tubular members as defined in claim 1 wherein said torque means comprises:

a. first gripping means and second gripping means, disposed at two different positions along said torque means, by which said torque means may simultaneously engage and apply torque to two tubular members, said first gripping means so acting on a first such tubular member in said first position and said second gripping means so acting on a second such tubular member; and b. differential means linking said third power means to said first and second gripping means, for simultaneously effecting application of torque by said first gripping means to said first such tubular member in one rotational sense and by said second gripping means to said second such tubular member in the opposite rotational sense.

16. Apparatus for manipulating tubular members as defined in claim 15 further comprising fourth power means for actuating said clamp means to selectively engage and disengage said tubular member.

17. Apparatus for manipulating pipe members comprising:

a. frame means, movable along a path in a substantially horizontal first direction;

b. way means, as part of said frame means, oriented in a substantially horizontal second direction, generally perpendicular to said first direction;

c. clamp means, mounted on slide means, and constrained thereby to movement along said way means to positions from a first extreme position to a second extreme position, and including an alignment position, for selectively engaging a pipe member and controlling movement of said pipe member by movement of said clamp means along said way means;

d. guide means, mounted on said frame means, for engaging a pipe member at said alignment position and orienting said pipe member, so engaged by said guide means, in a substantially vertical direction;

e. tong means joined to said frame means, selectively engagable with pipe members oriented in said substantially vertical direction in said alignment position for applying torque thereto; and f. first power means for actuating said tong means to so apply said torque.

18. Apparatus for manipulating pipe members as defined in claim 17 wherein said tong means comprises:

a. first gripping means and second gripping means, removed from said first gripping means, for simultaneously selectively gripping and applying torque to a first pipe member and a second pipe member, respectively, substantially vertically oriented at said alignment position; and b. gear means linking said first power means with said first and second gripping means for simultaneously effecting application of torque by said first gripping means to said first pipe member in one rotational sense and by said second gripping means to said second pipe member in the opposite rotational sense.

19. Apparatus for manipulating pipe members as defined in claim 18 wherein said tong means is selectively movable, with respect to said frame means, along said substantially vertical direction for applying said first and second gripping means to said first and second pipe members, respectively, at selected positions along said pipe members.

20. Apparatus for manipulating pipe members as defined in claim 19 further comprising second power means for selectiely moving said tong means along said substantially vertical direction.

21. Apparatus for manipulating pipe members as defined in claim 18 further comprising second power means for selectively moving said slide means and said clamp means along said way means.

22. Apparatus for manipulating pipe members as defined in claim 21 wherein said clamp means comprises:

a. cradle means for receiving and constraining said first pipe member;

b. latch means for selectively restraining said first pipe member within said cradle means; and c. third power means for selectively actuating said latch means to restrain and release said first pipe member.

23. Apparatus for manipulating pipe members as defined in claim 22 further comprising fourth power means for selectively moving said tong means into and out of engagement with said pipe members.

24. Apparatus for manipulating pipe members as defined in claim 23 further comprising fifth power means for selectively moving said guide means into and out of engagement with said pipe members in said alignment position.

25. Apparatus for manipulating pipe members as defined in claim 24 wherein said tong means is selectively movable, with respect to said frame means, along said substantially vertical direction for applying said first and second gripping means to said first and second pipe members, respectively, at selected positions along said pipe members.

26. Apparatus for manipulating pipe members as defined in claim 25 further comprising sixth power means for selectively moving said tong means along said substantially vertical direction.

27. Apparatus for manipulating pipe members as defined in claim 26 further comprising seventh power means for selectively moving said frame means along said path.

28. Apparatus for manipulating pipe members as defined in claim 27 further comprising track means for constraining said movement of said frame means along said path.

29. Apparatus for manipulating pipe members as defined in claim 28 wherein said seventh power means comprises cable means and sheave means whereby said frame means is propelled along said track means.

30. Apparatus for manipulating pipe members as defined in claim 17 further comprising second power means for selectively moving said frame means along said path.

31. Apparatus for manipulating pipe members as defined in claim 30 further comprising track means for constraining said movement of said frame means along said path.

32. Apparatus for manipulating pipe members as defined in claim 31 wherein said second power means comprises cable means and sheave means whereby said frame means is propelled along said track means.

33. Apparatus for manipulating pipe members as defined in claim 22 wherein said clamp means comprises:

a. cradle means for receiving and constraining a pipe member;

b. latch means for selectively restraining said pipe member within said cradle means; and c. third power means for selectively actuating said latch means to restrain and release said pipe member.

34. Apparatus for manipulating pipe members as defined in claim 33 further comprising fourth power means for selectively moving said slide means and said clamp means along said way means.

35. Apparatus for manipulating pipe members as defined in claim 34 wherein said tong means comprises:

a. first gripping means and second gripping means, removed from said first gripping means, for simultaneously selectively gripping and applying torque to a first pipe member and a second pipe member, respectively, substantially vertically oriented at said alignment position; and b. gear means linking said first power means with said first and second gripping means for simultaneously effecting application of torque by said first gripping means to said first pipe member in one rotational sense and by said second gripping means to said second pipe member in the opposite rotational sense.

36. Apparatus for manipulating pipe members as defined in claim 35 wherein said tong means is selectively movable, with respect to said frame means, along said substantially vertical direction for applying said first and second gripping means to said first and second pipe members, respectively, at selected positions along said pipe members.

37. Apparatus for manipulating pipe members as defined in claim 36 further comprising fifth power means for selectively moving said tong means along said substantially vertical direction.

38. A method of manipulating pipe members, having threaded ends, in operating on a well comprising the steps of:

a. providing lift means supported from mast means having a floor level;
b. providing manipulating means supported substantially at said floor level;
c. extending said pipe members above said floor level;
d. attaching said lift means to said pipe members, and elevating said pipe members thereby, while receiving said pipe members by said manipulating means;
e. guiding said pipe members by said manipulating means while further elevating said pipe members by said lift means by moving said manipulating means parallel to said floor level, thereby positioning said pipe members over said well and orienting them essentially vertically;
f. contacting said pipe members to a drill string extending above the bore of said well; and;
g. applying torque to said pipe members, by said manipulating means, to rotate said pipe members with respect to said drill string, thereby threadedly joining said pipe members to said drill string.

39. A method of manipulating pipe members as defined in claim 38 further comprising the step of applying torque, by said manipulating means, to said drill string in one rotational sense while performing the step of applyimg torque, by said manipulating means, to said pipe members in the opposite rotational sense, to threadedly join said pipe members to said drill string.

40. A method of manipulating pipe members, having threaded ends, in operating on a well comprising the steps of:

a. providing lift means supported from mast means having a floor level;
b. providing manipulating means supported substantially at said floor level;
c. attaching said lift means to said pipe members, threadedly joined to the top of a drill string positioned in the bore of said well, and elevating said pipe members and said drill string thereby, until the connection between the bottom of said pipe members and the top of said drill string is above said floor level;
d. applying torque to said pipe members, by said manipulating means, to rotate said pipe members with respect to said drill string;
e. separating said pipe members from said drill string;
f. moving said pipe members, by said manipulating means, away from said bore of said well toward a receiving area;
g. lowering said pipe members by said lift means while guiding said pipe members, by said manipulating means, to extend beyond said floor level to said receiving area; and
h. releasing said pipe members from said lift means.

41. A method of manipulating pipe members as defined in claim 40 further comprising the step of applying torque, by said manipulating means, to said drill string in one rotational sense while performing the step of applying torque, by said manipulating means, to said pipe members in the opposite rotational sense, to disconnect said pipe members from said drill string.

* * * * *

UNITED STATES PATENT AND TRADEMARK OFFICE

CERTIFICATE OF CORRECTION

PATENT NO. : 4,069,879

DATED : January 24, 1978

INVENTOR(S) : Cicero C. Brown

It is certified that error appears in the above-identified patent and that said Letters Patent are hereby corrected as shown below:

Column 6, line 6, delete the word "powdered" and insert therefor --powered--.

Column 9, line 29, delete the word "directiion" and insert therefor --direction--.

In the Claims

Claim 1, (d) line 32, delete the word "saib" and insert therefor --said--.

Claim 9, line 25, delete the word "generaly" and insert therefor --generally--.

Claim 20, line 50, delete the word "selectiely" and insert therefor --selectively--.

Claim 33, line 42, delete the number "22" and insert therefor --32--.

Signed and Sealed this

*Eleventh* Day of *July 1978*

[SEAL]

*Attest:*

RUTH C. MASON
*Attesting Officer*

DONALD W. BANNER
*Commissioner of Patents and Trademarks*